US009144883B2

(12) United States Patent
Huang et al.

(10) Patent No.: US 9,144,883 B2
(45) Date of Patent: Sep. 29, 2015

(54) ABRASIVE ARTICLE, CONDITIONING DISK AND METHOD FOR FORMING ABRASIVE ARTICLE

(71) Applicant: Taiwan Semiconductor Manufacturing Co., Ltd, Hsin-Chu (TW)

(72) Inventors: Po-Chun Huang, Dacun Township (TW); Yen-Chang Chao, Taichung (TW); Kaw-Wei Kuo, Tainan (TW)

(73) Assignee: TAIWAN SEMICONDUCTOR MANUFACTURING CO., LTD, Hsin-Chu (TW)

( * ) Notice: Subject to any disclaimer, the term of this patent is extended or adjusted under 35 U.S.C. 154(b) by 0 days.

(21) Appl. No.: 14/178,793

(22) Filed: Feb. 12, 2014

(65) Prior Publication Data

US 2015/0224624 A1 Aug. 13, 2015

(51) Int. Cl.

| | |
|---|---|
| ***B24B 53/017*** | (2012.01) |
| ***B24D 18/00*** | (2006.01) |
| ***B24D 3/08*** | (2006.01) |

(52) U.S. Cl.

CPC ..... *B24B 53/017* (2013.01); *B24D 3/08* (2013.01); *B24D 18/0054* (2013.01)

(58) Field of Classification Search

CPC ..... B24B 53/07; B24B 53/12; B24D 3/06; C04B 37/006; C04B 37/026; C04B 2237/122; C09K 3/1409

USPC ..... 451/443, 540–559; 228/121, 122.1, 228/245–262; 51/309

See application file for complete search history.

(56) References Cited

U.S. PATENT DOCUMENTS

| | | | | | |
|---|---|---|---|---|---|
| 3,776,827 | A | * | 12/1973 | Inoue | 205/662 |
| 4,009,027 | A | * | 2/1977 | Naidich et al. | 420/473 |
| 4,457,765 | A | * | 7/1984 | Wilson | 51/293 |
| 4,555,250 | A | * | 11/1985 | Horie et al. | 51/309 |
| 4,655,795 | A | * | 4/1987 | Bleecker et al. | 51/309 |
| 4,667,871 | A | * | 5/1987 | Mizuhara | 228/122.1 |
| 4,919,974 | A | * | 4/1990 | McCune et al. | 427/249.7 |
| 4,968,326 | A | * | 11/1990 | Wiand | 51/293 |
| 4,992,082 | A | * | 2/1991 | Drawl et al. | 51/295 |
| 5,002,218 | A | * | 3/1991 | Ueoka et al. | 228/121 |
| 5,750,261 | A | * | 5/1998 | Kurihara et al. | 428/422.8 |
| 6,273,924 | B1 | * | 8/2001 | Krenkel et al. | 51/307 |
| 2005/0260939 | A1 | * | 11/2005 | Andrews et al. | 451/443 |
| 2012/0149287 | A1 | * | 6/2012 | Wu et al. | 451/443 |
| 2014/0366458 | A1 | * | 12/2014 | Roy et al. | 51/309 |

* cited by examiner

*Primary Examiner* — George Nguyen

(74) *Attorney, Agent, or Firm* — Birch, Stewart, Kolasch & Birch, LLP

(57) ABSTRACT

In accordance with some embodiments, an abrasive article is provided. The abrasive article includes a carrier. The abrasive article further includes a matrix layer on the carrier. The matrix layer includes a copper-titanium-tin alloy, wherein the copper-titanium-tin alloy includes from about 70 wt % to about 90 wt % of copper, from about 5 wt % to about 15 wt % of titanium, and from about 5 wt % to about 15 wt % of tin. The abrasive article also includes at least one abrasive particle partially embedded in the matrix layer. The abrasive particle includes carbon.

16 Claims, 4 Drawing Sheets

ABRASIVE ARTICLE, CONDITIONING DISK AND METHOD FOR FORMING ABRASIVE ARTICLE

BACKGROUND

The semiconductor integrated circuit (IC) industry has experienced rapid growth. Technological advances in IC materials and design have produced generations of ICs where each generation has smaller and more complex circuits than the previous generation. However, these advances have increased the complexity of processing and manufacturing ICs and, for these advances to be realized, similar developments in IC processing and manufacturing are needed. In the course of IC evolution, functional density (i.e., the number of interconnected devices per chip area) has generally increased while geometry size (i.e., the smallest component (or line) that can be created using a fabrication process) has decreased. This scaling down process generally provides benefits by increasing production efficiency and lowering associated costs.

In recent decades, the chemical mechanical polishing (CMP) process has been used to planarize layers used to build up ICs, thereby helping to provide more precisely structured device features on the ICs. The CMP process is a planarization process that combines chemical removal with mechanical polishing. The CMP process is a favored process because it achieves global planarization across the entire wafer surface. The CMP polishes and removes materials from the wafer, and works on multi-material surfaces. Furthermore, the CMP process avoids the use of hazardous gasses, and/or is usually a low-cost process.

Since the CMP process is one of the important processes for forming ICs, it is desired to have mechanisms to maintain the reliability and the yield of the CMP process.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
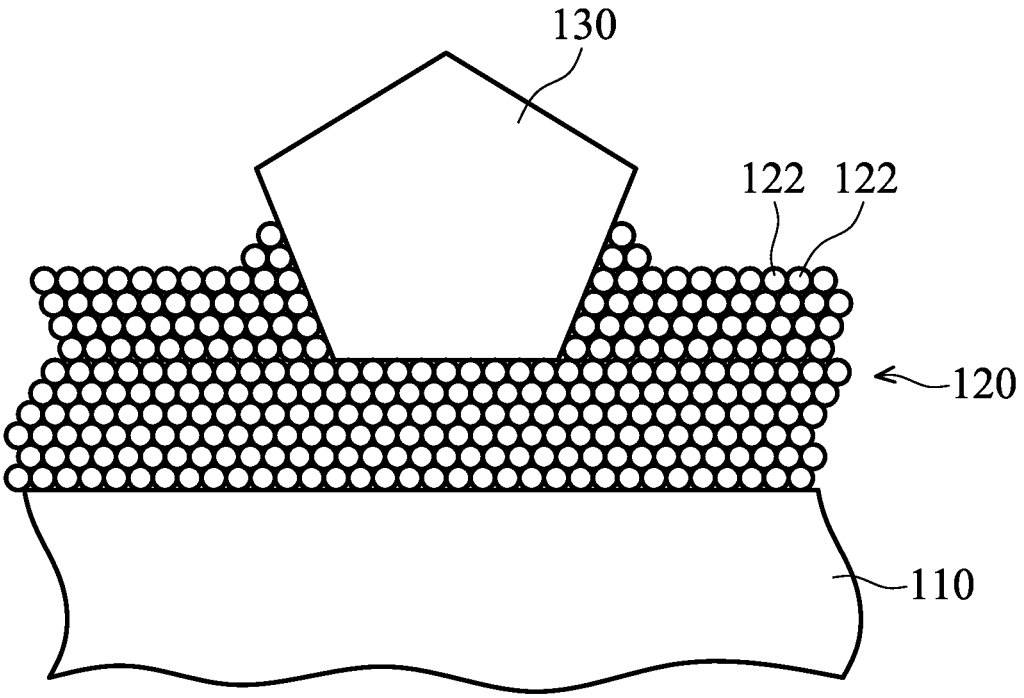
FIGS. 1A-1B are cross-sectional views of various stages of a process for forming an abrasive article, in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. It is understood that additional operations can be provided before, during, and after the method, and some of the operations described can be replaced or eliminated for other embodiments of the method.

Figure 1B:
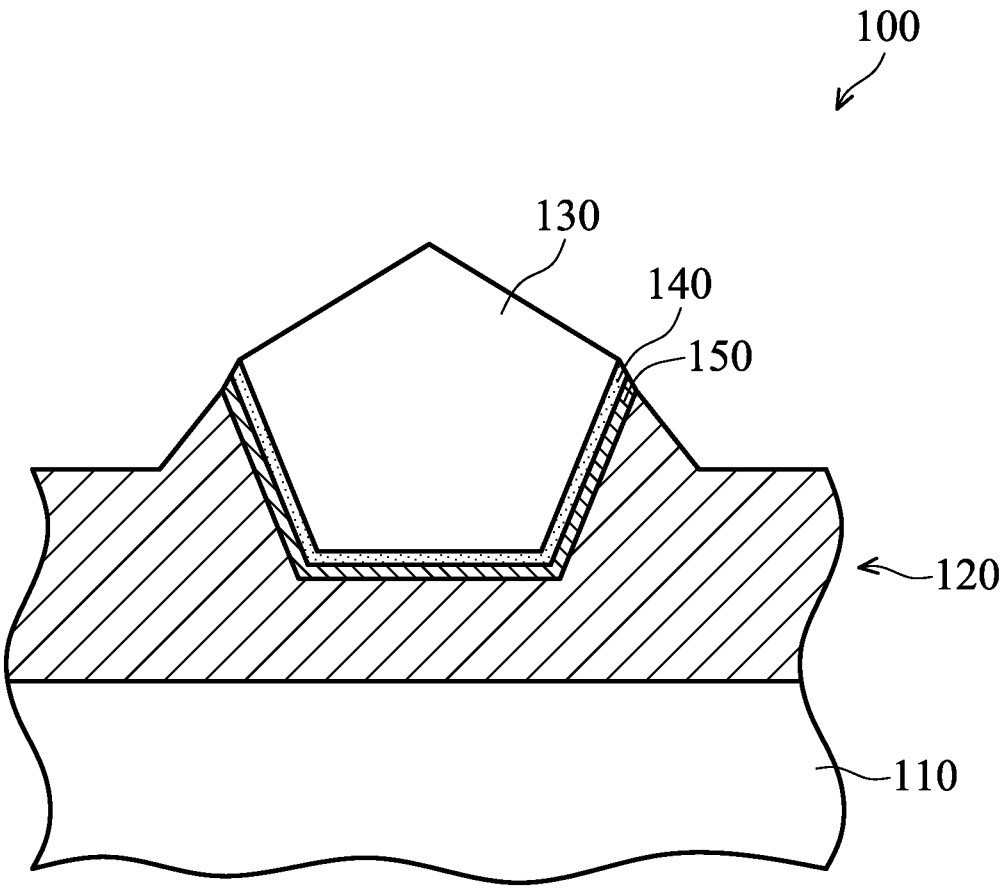

FIGS. 1A-1B are cross-sectional views of various stages of a process for forming an abrasive article 100, in accordance with some embodiments. As shown in FIG. 1A, a carrier 110 is provided, in accordance with some embodiments. The carrier 110 is a substrate or other suitable objects (e.g., a shank or a circular disc substrate). The carrier 110 includes stainless steel, iron or other suitable materials. In some embodiments, a matrix layer 120 is formed on the carrier 110. The matrix layer 120 includes copper-titanium-tin alloy particles 122, in accordance with some embodiments.

In some embodiments, the copper-titanium-tin alloy particles 122 include from about 70 wt % to about 90 wt % of copper, from about 5 wt % to about 15 wt % of titanium, and from about 5 wt % to about 15 wt % of tin. In some embodiments, the copper-titanium-tin alloy particles 122 include from about 70 wt % to about 80 wt % of copper. In some embodiments, the copper-titanium-tin alloy particles 122 include from about 10 wt % to about 15 wt % of titanium. In some embodiments, the copper-titanium-tin alloy particles 122 include from about 10 wt % to about 15 wt % of tin.

Afterwards, an abrasive particle 130 is provided on the matrix layer 120, in accordance with some embodiments. It should be noted that, for the sake of simplicity, FIGS. 1A and 1B show only one abrasive particle 130 for illustration, but does not limit the invention thereto. In some other embodiments, there are two or more abrasive particles 130 provided on the matrix layer 120. The abrasive particle 130 includes carbon, in accordance with some embodiments. The abrasive particle 130 includes a diamond particle (or a diamond grit), in accordance with some embodiments.

Thereafter, as shown in FIG. 1B, a heating process is performed to heat the matrix layer 120 so as to soften or melt the matrix layer 120, in accordance with some embodiments. Therefore, the copper-titanium-tin alloy of the matrix layer 120 is transformed from a solid phase to a liquid phase and flows to contact with and surround a portion of the abrasive particle 130, in accordance with some embodiments. In the heating process, a pressure is applied to the matrix layer 120, the abrasive particle 130 and the carrier 110, in accordance with some embodiments.

Afterwards, the copper-titanium-tin alloy of the matrix layer 120 cools and returns to its solid phase, and the matrix layer 120 serves to hold the abrasive particle 130, in accordance with some embodiments. The abrasive particle 130 is partially embedded in the matrix layer 120, in accordance with some embodiments.

In some embodiments, a titanium carbide layer 140 is formed between the abrasive particle 130 and the matrix layer 120 after the heating process. The titanium carbide layer 140 is in direct contact with the abrasive particle 130, in accordance with some embodiments. In some embodiments, a titanium-tin alloy layer 150 is formed between the titanium carbide layer 140 and the matrix layer 120 after the heating process, and the titanium carbide layer 140 is located between the abrasive particle 130 and the titanium-tin alloy layer 150. In some embodiments, the titanium-tin alloy layer 150 is in direct contact with the titanium carbide layer 140 and the matrix layer 120. In some embodiments, the titanium-tin alloy layer 150 includes $SnTi_3$, $Sn_5Ti_6$ and/or $SnTi_2$.

In some embodiments, the titanium carbide layer 140 has a good adhesion to both the abrasive particle 130 and the titanium-tin alloy layer 150, and the titanium-tin alloy layer 150 has a good adhesion to both the titanium carbide layer 140 and the matrix layer 120. Therefore, the matrix layer 120 securely holds the abrasive particle 130 through the titanium carbide layer 140 and the titanium-tin alloy layer 150, in accordance with some embodiments.

In some embodiments, a heating temperature of the heating process ranges from about 600° C. to about 1200° C. In some embodiments, the heating temperature of the heating process ranges from about 800° C. to about 1000° C. The melting point (or the softening temperature) of the copper-titanium-tin alloy is lower than the graphitization temperature (≥1300° C.) of diamond, which prevents the diamond (i.e., the abrasive particle 130) from graphitization, in accordance with some embodiments. Therefore, the abrasive particle 130 is prevented from cracks induced by the graphitization during the heating process, in accordance with some embodiments.

In some embodiments, after the heating process, a holding temperature process is performed to form stable ternary alloys (e.g., CuTiSn and $CuTi_5Sn_3$) in the matrix layer 120. In some embodiments, the process temperature of the holding temperature process ranges from about 600° C. to about 1000° C. In some embodiments, the process temperature of the holding temperature process ranges from about 800° C. to about 900° C.

The content of the CuTiSn ternary alloy and the $CuTi_5Sn_3$ ternary alloy in the matrix layer 120 is positively relative to the process temperature and the process time of the holding temperature process, in accordance with some embodiments. Therefore, the content of the CuTiSn ternary alloy and the $CuTi_5Sn_3$ ternary alloy in the matrix layer 120 can be adjusted by adjusting the process temperature and the process time of the holding temperature process, in accordance with some embodiments.

In some embodiments, since the CuTiSn ternary alloy and the $CuTi_5Sn_3$ ternary alloy in the matrix layer 120 consume titanium and tin of the matrix layer 120, the content of the CuTiSn ternary alloy and the $CuTi_5Sn_3$ ternary alloy in the matrix layer 120 is negatively relative to the thickness of the titanium-tin alloy layer 150. Therefore, the titanium-tin alloy layer 150 may be adjusted to have a suitable thickness by adjusting the process temperature and the process time of the holding temperature process, in accordance with some embodiments.

In this step, an abrasive article 100 is formed. The abrasive article 100 serves to smooth, polish, grind, cut and/or scratch objects by using the abrasive particle 130, in accordance with some embodiments. In some embodiments, the carrier 110 is a substrate, and the abrasive article 100 is a conditioning disk of a chemical mechanical polishing system (CMP system). In some embodiments, the carrier 110 is a circular disc substrate, and the abrasive article 100 is a diamond wheel (or a diamond grinding wheel). In some embodiments, the carrier 110 is a shank, and the abrasive article 100 is a diamond knife (or a diamond tool). In some embodiments, for the sake of simplicity, FIG. 1B merely shows a portion of the abrasive article 100.

Figure 2:
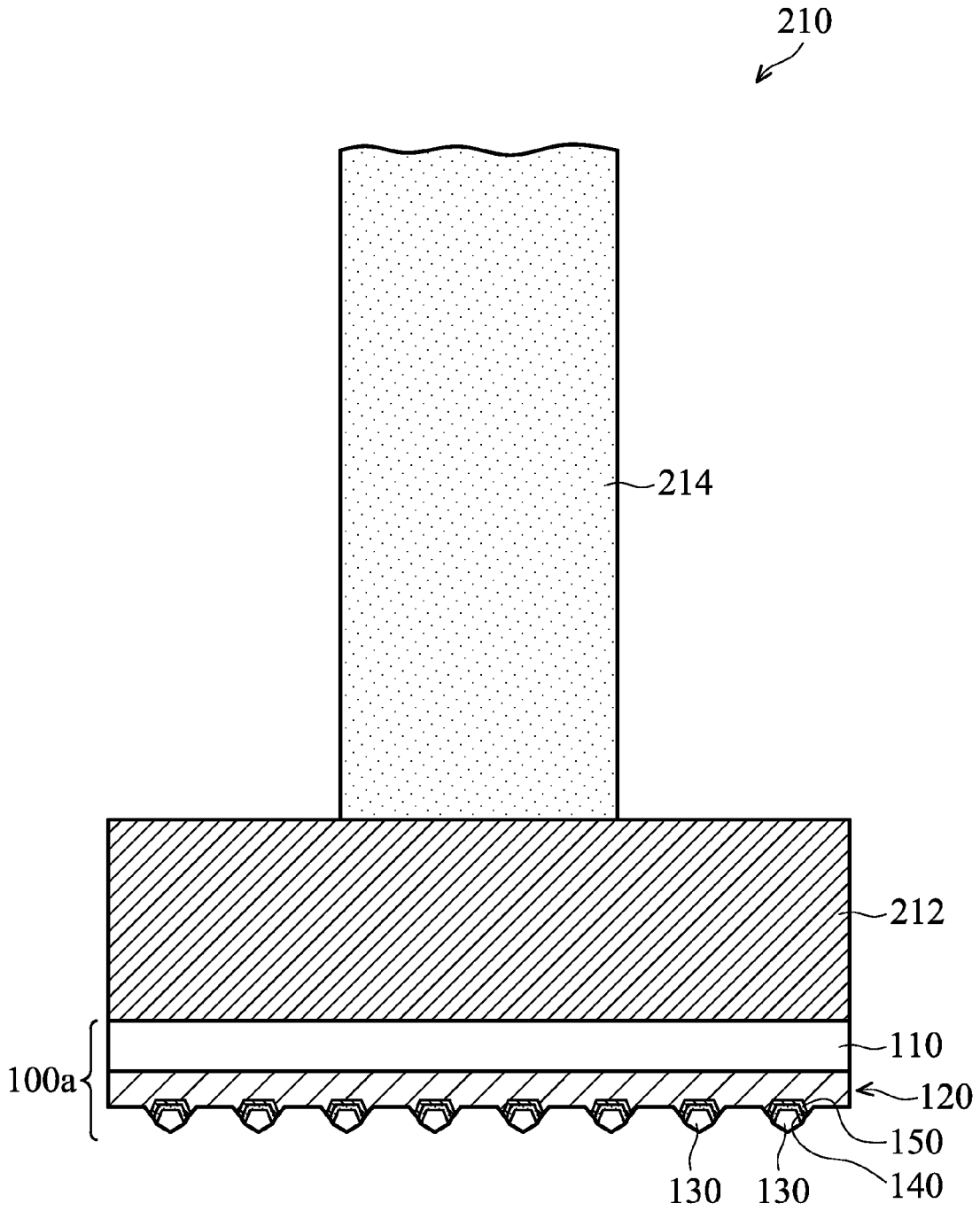
FIG. 2 is a cross-sectional view of a conditioning assembly with a conditioning disk, in accordance with some embodiments.

FIG. 2 is a cross-sectional view of a conditioning assembly with a conditioning disk, in accordance with some embodiments. As shown in FIG. 2, a conditioning assembly 210 includes a conditioning disk 100*a*, a conditioning head 212 and a conditioning arm 214. The conditioning disk 100*a* is similar to the abrasive article 100 of FIG. 1B, except that the conditioning disk 100*a* has abrasive particles 130 partially embedded in the matrix layer 120.

The conditioning disk 100*a* is connected with (or mounted to) the conditioning head 212, in accordance with some embodiments. The conditioning head 212 is connected with (or mounted to) the conditioning arm 214, in accordance with some embodiments. The conditioning assembly 210 is configured to condition (or refresh) a polishing pad of a CMP system. The CMP system is described in detail as follows.

Figure 3:
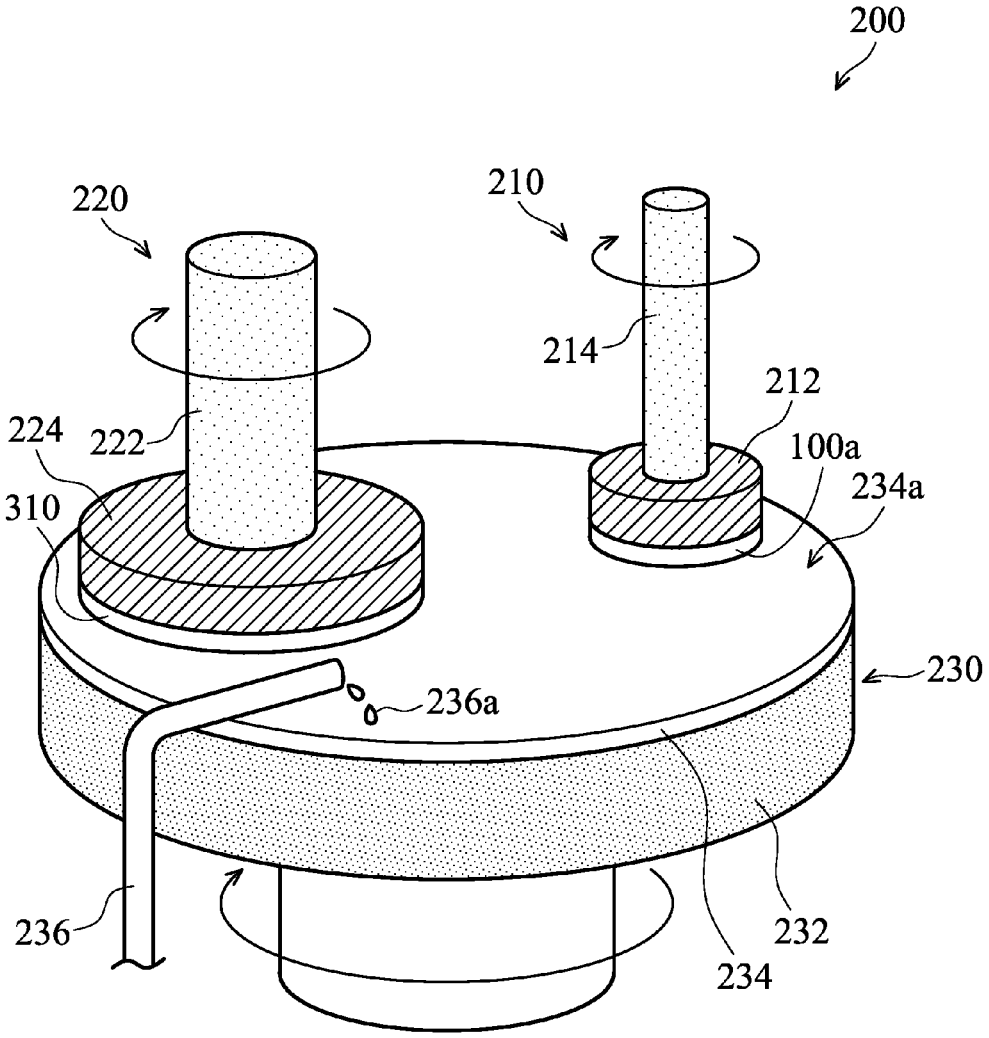
FIG. 3 is a perspective view of a CMP system, in accordance with some embodiments.

FIG. 3 is a perspective view of a CMP system 200, in accordance with some embodiments. As shown in FIG. 3, a CMP system 200 includes the conditioning assembly 210, a wafer carrying assembly 220 and a polishing assembly 230, in accordance with some embodiments. The polishing assembly 230 includes a rotatable platen 232, a polishing pad 234 and a slurry supply 236, in accordance with some embodiments. The polishing pad 234 is mounted on the rotatable platen 232, in accordance with some embodiments.

The wafer carrying assembly 220 is used to hold a wafer 310 against the polishing assembly 230 to perform a CMP process. The wafer carrying assembly 220 includes a wafer arm 222 and a wafer carrier 224 mounted to the wafer arm 222. The wafer carrier 224 is configured to hold the wafer 310 to engage a surface of the wafer 310 with the polishing pad 234 and provide a downward pressure on the wafer 310, in accordance with some embodiments.

When the CMP process is performed, the polishing pad 234 is in direct contact with the wafer 310 and spun by the rotatable platen 232, in accordance with some embodiments. A slurry 236*a* is continuously provided on the polishing pad 234 by the slurry supply 236 during the CMP process, in accordance with some embodiments. In some embodiments, the wafer 310 is also rotated by the wafer carrying assembly 220 during the CMP process.

The polishing pad 234 is a porous structure, and has a rough polishing surface 234*a*. When the polishing process is performed, polishing debris (coming from, for example, the removed portion of the wafer 310 and the slurry particles) fills the pores of the polishing pad 234. Therefore, the polishing surface 234*a* of the polishing pad 234 becomes smooth, and the surface roughness of the polishing pad 234 is decreased. As a result, the polishing rate is decreased.

In order to maintain the polishing rate, the polishing pad 234 needs to be conditioned to maintain the surface roughness. A conditioning operation (or a dressing operation) is performed to the polishing pad 234 by using the conditioning assembly 210, in accordance with some embodiments. The conditioning disc 100*a* is used to refresh and scratch the polishing surface 234*a* of the polishing pad 234. A lower portion of the polishing pad 234, which is fresh, is thus exposed and continues to be used for polishing. Due to the dressing by the conditioning disc 100*a*, the polishing surface 234*a* of the polishing pad 234 is refreshed and the CMP rate is maintained.

During the CMP process, if the abrasive particles 130 (as shown in FIG. 2) fall from the conditioning disc 100*a*, the wafer 310 is easily scratched by the abrasive particles 130. Since the matrix layer 120 securely holds the abrasive particles 130 through the titanium carbide layer 140 and the titanium-tin alloy layer 150 (as shown in FIG. 2), the wafer 310 is prevented from being scratched by the abrasive particles 130. Therefore, the yield of the CMP process using the CMP system 200 is improved.

In accordance with some embodiments, abrasive articles, conditioning disks and methods for forming the abrasive articles are provided. A copper-titanium-tin alloy is used to form a matrix layer for affixing abrasive particles onto a carrier. The abrasive articles may be diamond particles. Since the melting point of the copper-titanium-tin alloy is lower than the graphitization temperature of diamond, the abrasive particles (i.e., the diamond particles) are prevented from being graphitized. Furthermore, a titanium carbide layer and a titanium-tin alloy layer formed between the abrasive particles and the matrix layer facilitate fixing the abrasive particles on the matrix layer.

In accordance with some embodiments, an abrasive article is provided. The abrasive article includes a carrier. The abrasive article further includes a matrix layer on the carrier. The matrix layer includes a copper-titanium-tin alloy, wherein the copper-titanium-tin alloy includes from about 70 wt % to about 90 wt % of copper, from about 5 wt % to about 15 wt % of titanium, and from about 5 wt % to about 15 wt % of tin. The abrasive article also includes at least one abrasive particle embedded in the matrix layer. The abrasive particle includes carbon.

In accordance with some embodiments, a conditioning disk is provided. The conditioning disk includes a carrier. The conditioning disk further includes a matrix layer on the carrier. The matrix layer includes a copper-titanium-tin alloy, wherein the copper-titanium-tin alloy includes from about 70 wt % to about 90 wt % of copper, from about 5 wt % to about 15 wt % of titanium, and from about 5 wt % to about 15 wt % of tin. The conditioning disk also includes at least one abrasive particle partially embedded in the matrix layer. The abrasive particle includes carbon. The conditioning disk further includes a titanium carbide layer between the abrasive particle and the matrix layer.

In accordance with some embodiments, a method for forming an abrasive article is provided. The method includes forming a matrix layer on a carrier. The matrix layer includes a copper-titanium-tin alloy. The copper-titanium-tin alloy includes from about 70 wt % to about 90 wt % of copper, from about 5 wt % to about 15 wt % of titanium, and from about 5 wt % to about 15 wt % of tin. The method further includes providing at least one abrasive particle on the matrix layer, and the abrasive particle includes carbon. The method also includes heating the matrix layer to soften or melt the matrix layer.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An abrasive article, comprising:

a carrier;

a matrix layer on the carrier, wherein the matrix layer comprises a copper-titanium-tin alloy, wherein the copper-titanium-tin alloy comprises from about 70 wt % to about 90 wt % of copper, from about 5 wt % to about 15 wt % of titanium, and from about 5 wt % to about 15 wt % of tin, and the copper-titanium-tin alloy comprises $CuTi_5Sn_3$; and at least one abrasive particle embedded in the matrix layer, wherein the abrasive particle comprises carbon.

2. The abrasive article as claimed in claim 1, wherein the copper-titanium-tin alloy comprises from about 70 wt % to about 80 wt % of copper.

3. The abrasive article as claimed in claim 2, wherein the copper-titanium-tin alloy comprises from about 10 wt % to about 15 wt % of titanium.

4. The abrasive article as claimed in claim 3, wherein the copper-titanium-tin alloy comprises from about 10 wt % to about 15 wt % of tin.

5. The abrasive article as claimed in claim 1, wherein the copper-titanium-tin alloy further comprises CuTiSn.

6. The abrasive article as claimed in claim 1, wherein the abrasive particle comprises a diamond particle.

7. A conditioning disk, comprising:

a carrier;

a matrix layer on the carrier, wherein the matrix layer comprises a copper-titanium-tin alloy, wherein the copper-titanium-tin alloy comprises from about 70 wt % to about 90 wt % of copper, from about 5 wt % to about 15 wt % of titanium, and from about 5 wt % to about 15 wt % of tin;

at least one abrasive particle partially embedded in the matrix layer, wherein the abrasive particle comprises carbon;

a titanium carbide layer between the abrasive particle and the matrix layer; and a titanium-tin alloy layer between the titanium carbide layer and the matrix layer.

8. The conditioning disk as claimed in claim 7, wherein the titanium carbide layer is in direct contact with the abrasive particle.

9. The conditioning disk as claimed in claim 7, wherein the titanium-tin alloy layer is in direct contact with the titanium carbide layer and the matrix layer.

10. The conditioning disk as claimed in claim 7, wherein the copper-titanium-tin alloy comprises CuTiSn and $CuTi_5Sn_3$.

11. The conditioning disk as claimed in claim 7, wherein the copper-titanium-tin alloy comprises from about 70 wt % to about 80 wt % of copper.

12. The conditioning disk as claimed in claim 11, wherein the copper-titanium-tin alloy comprises from about 10 wt % to about 15 wt % of titanium.

13. The conditioning disk as claimed in claim 12, wherein the copper-titanium-tin alloy comprises from about 10 wt % to about 15 wt % of tin.

14. A method for forming an abrasive article, comprising:

forming a matrix layer on a carrier, wherein the matrix layer comprises a copper-titanium-tin alloy, wherein the copper-titanium-tin alloy comprises from about 70 wt % to about 90 wt % of copper, from about 5 wt % to about 15 wt % of titanium, and from about 5 wt % to about 15 wt % of tin;

providing at least one abrasive particle on the matrix layer, wherein the abrasive particle comprises carbon; and heating the matrix layer to soften or melt the matrix layer, wherein a titanium carbide layer and a titanium-tin alloy layer are formed between the abrasive particle and the matrix layer after the heating, and the titanium-tin alloy layer is between the titanium carbide layer and the matrix layer.

15. The method for forming a method for forming an abrasive article as claimed in claim 14, wherein a heating temperature of the heating ranges from about 600° C. to about 1200° C.

16. The method for forming a method for forming an abrasive article as claimed in claim 15, wherein the heating temperature of the heating ranges from about 800° C. to about 1000° C.

* * * * *